US008678526B2

(12) United States Patent
Burks

(10) Patent No.: US 8,678,526 B2
(45) Date of Patent: Mar. 25, 2014

(54) ADJUSTABLE HINGE

(76) Inventor: Ben Burks, Atlanta, GA (US)

( * ) Notice: Subject to any disclaimer, the term of this patent is extended or adjusted under 35 U.S.C. 154(b) by 0 days.

(21) Appl. No.: 13/446,406

(22) Filed: Apr. 13, 2012

(65) Prior Publication Data

US 2012/0246876 A1 Oct. 4, 2012

Related U.S. Application Data

(62) Division of application No. 12/388,410, filed on Feb. 18, 2009, now abandoned.

(51) Int. Cl.
*A47B 88/18* (2006.01)

(52) U.S. Cl.
USPC ..... 312/325; 16/375

(58) Field of Classification Search
USPC ..... 312/321.5, 326, 327, 328, 325; 16/49, 16/50, 82, 374, 375, 236, 237, 278
See application file for complete search history.

(56) References Cited

U.S. PATENT DOCUMENTS

| | | | | | |
|---|---|---|---|---|---|
| 1,739,239 | A | * | 12/1929 | Keffer | 131/241 |
| 3,187,372 | A | * | 6/1965 | Parsons | 16/375 |
| 3,292,983 | A | * | 12/1966 | Service | 312/228 |
| 3,879,072 | A | * | 4/1975 | Tuley | 292/268 |
| 3,913,171 | A | * | 10/1975 | Reid | 16/375 |
| 4,177,540 | A | | 12/1979 | Gorton | |
| 4,376,324 | A | | 3/1983 | Lautenschlager et al. | |
| 4,506,409 | A | | 3/1985 | Lautenschlager | |
| 4,675,941 | A | | 6/1987 | Grass | |
| 4,716,622 | A | | 1/1988 | DeBruyn | |
| 4,720,896 | A | | 1/1988 | Lautenschlager et al. | |
| 4,729,616 | A | * | 3/1988 | Vogt | 312/325 |
| 4,756,054 | A | * | 7/1988 | Mitts et al. | 16/237 |
| 4,843,680 | A | * | 7/1989 | Cress et al. | 16/289 |
| 4,998,941 | A | * | 3/1991 | Smith | 16/375 |
| 5,027,474 | A | | 7/1991 | Bowers | |
| 5,175,908 | A | | 1/1993 | Domenig | |
| 5,237,724 | A | * | 8/1993 | Lee | 16/375 |
| 5,369,841 | A | | 12/1994 | Bembnowski | |
| RE34,995 | E | | 7/1995 | Domenig | |
| 5,617,612 | A | | 4/1997 | Ferrari et al. | |
| 5,727,289 | A | * | 3/1998 | Reder | 16/375 |
| 5,915,804 | A | * | 6/1999 | Crescenzo | 312/325 |
| 6,049,946 | A | * | 4/2000 | Cress et al. | 16/240 |
| 6,470,531 | B2 | | 10/2002 | Domenig et al. | |
| 2006/0043850 | A1 | * | 3/2006 | Rapier | 312/321.5 |

OTHER PUBLICATIONS

Rev-A-Shelf, Tip Out Tray System Installation Instructions, Rev. 08-00.

* cited by examiner

*Primary Examiner* — James O Hansen
(74) *Attorney, Agent, or Firm* — Seyfarth Shaw LLP

(57) ABSTRACT

A hinge, comprising a cup having a rim and an arm pivotably connected to the cup, wherein the arm is permitted to pivot between a closed position and an open position, the open position defining a opening angle between the cup and arm. An adjustable stopper coupled to the arm is engagable with the rim whereby the opening angle is controlled by adjustment of the stopper.

5 Claims, 11 Drawing Sheets

ADJUSTABLE HINGE

CROSS REFERENCE TO RELATED APPLICATION

This application is a divisional of U.S. patent application Ser. No. 12/388,410, filed Feb. 18, 2009 now abandoned.

FIELD OF THE INVENTION

This invention relates generally to an adjustable hinge and, more particularly, to a hinge with an adjustment mechanism for controlling the opening angle of the hinge.

BACKGROUND

Most hinges designed for use in entry way doors or cabinet frames permit an opening angle 90 degrees or greater in order to permit sufficient access to the storage area for the user. Yet, there are some situations where it is desirable to use a hinge that restricts the angle to 90 degrees or less. For example, some households are equipped with a "sink" or "tip-out" tray mounted in an opening on the front panel of a kitchen sink cabinet, directly in-front of the sink tub. These types of tray mechanisms and their corresponding hinges are specially designed to permit the tray to pivot in and out of the tight space formed between the frame of the sink cabinet, counter top and sink tub.

While hinges for sink trays are known in the art, such prior art hinges are in the form of scissor-type hinges, such as the first and second prior art hinges 100, 101 shown in FIGS. 1 and 2, respectively. The first and second prior art hinges 100, 101 incorporate a complex system of levers, panels, pins and coil springs and are relatively expensive because of their complexity and the amount of material they use. These prior art hinges are also designed to be mounted to the side walls of the sink cabinet, which reduces the space available for the sink tray.

Accordingly, it is desirable to have a hinge with a simple, compact and economical design that includes an adjustment mechanism for controlling the opening angle so it can be used in conjunction with cabinet or door systems—such as sink tray system or the like—where it is desirable to be able to adjust the permitted opening angle.

SUMMARY

In an embodiment, the hinge of the present application comprises a recessed cup and arm, the arm being pivotably connected to the cup. One end of the cup includes securing flanges adapted to engage a panel. At the opposite end of the cup a slanted rim is formed atop the recessed portion of the cup.

In one form, a mounting plate is formed on one portion of the arm and is adapted to be fastened to a cabinet frame or other mounting structure. At the other portion of the arm, referred to herein as the second portion, the arm is bent in order to form a curl that winds around a hinge pin secured in the cup, thereby permitting the arm to pivot relative to the cup. As the arm pivots from a closed position to an open position, an opening angle A is formed between the outer surface of the cabinet frame and inner surface of the panel.

An adjustable stopper disposed along a first axis X-X is threaded through a passage formed in the second portion of the arm. A second end of the stopper extends into the cup, and may be beveled in order to form a shoulder disposed at an angle relative to the first axis X-X. As the arm pivots to the closed position, the shoulder contacts the rim, whereby the rim operates as a abutment for the stopper.

The hinge may be incorporated in a sink tray system where a sink tray or tip-out tray is mounted to the inner surface of the cabinet panel using fastening screws or the like. It will be appreciated that the hinge and its corresponding adjustment mechanism permits the tray to pivot in and out of the tight space formed between the fame of the sink cabinet, counter top and sink tub.

BRIEF DESCRIPTION OF THE DRAWINGS

For the purpose of facilitating an understanding of the subject matter sought to be protected, there is illustrated in the accompanying drawings embodiments thereof, from an inspection of which, when considered in connection with the following description, the subject matter sought to be protected, its construction and operation, and many of its advantages, should be readily understood and appreciated.

DETAILED DESCRIPTION

Figure 1:
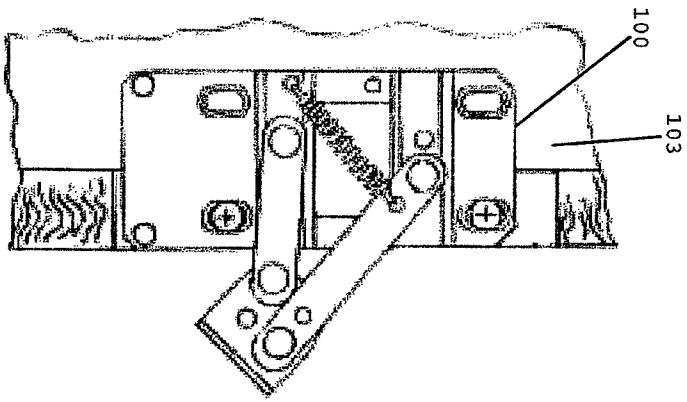
Fig 1. Prior Art
FIG. 1 is a partial cross-sectional view of a first prior art sink tray hinge.
Figure 2:
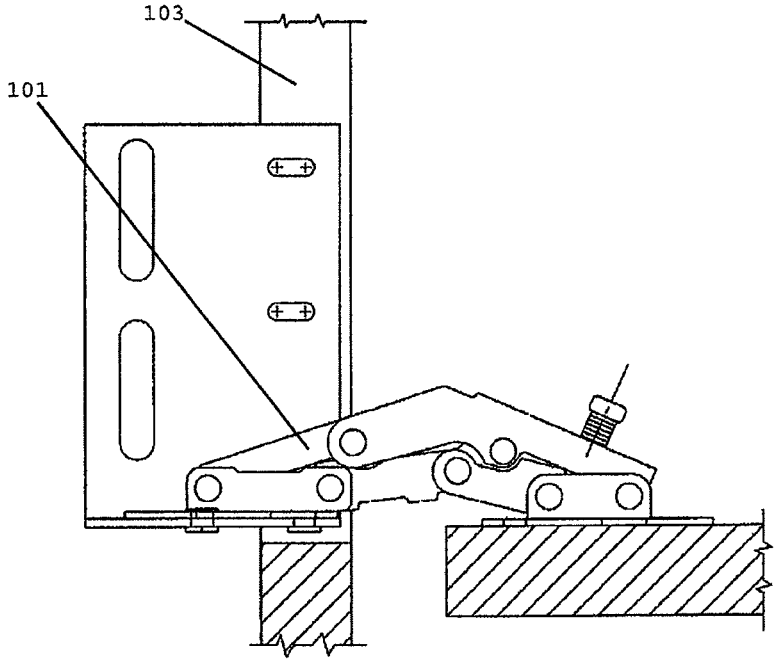
Fig. 2 Prior Art
FIG. 2 is a partial cross-sectional view of a second prior art sink tray hinge.
Figure 3:
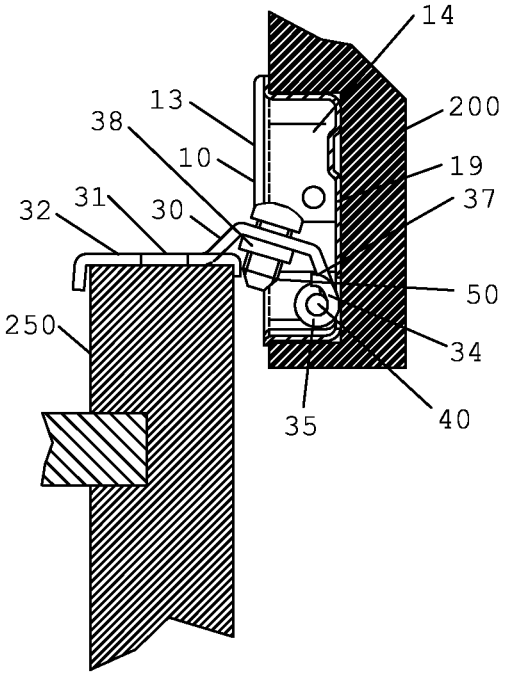
FIG. 3 is a partial cross-sectional view of an embodiment of the hinge of the present application where the hinge is shown in the closed position.
Figure 4:
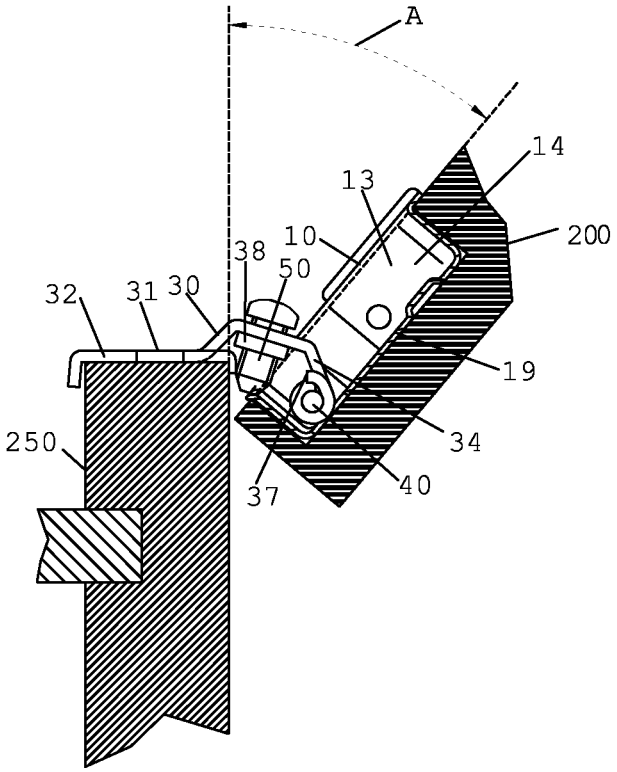
FIG. 4 is a partial cross-sectional view of the hinge of FIG. 3, but showing the hinge in the open position.

While the present invention is susceptible of embodiments in many different forms, there is shown in the drawings and will herein be described a preferred embodiment of the invention with the understanding that the present disclosure is to be considered as an exemplification of the principles of the invention and is not intended to limit the broad aspect of the invention to embodiments illustrated.

Figure 5:
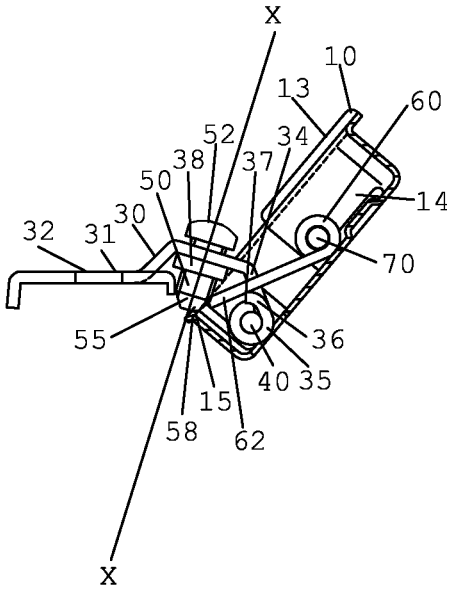
FIG. 5 is an enlarged partial cross-sectional view of the hinge of FIG. 4, but showing the components of the self-closing/self opening functions in more detail.
Figure 6:
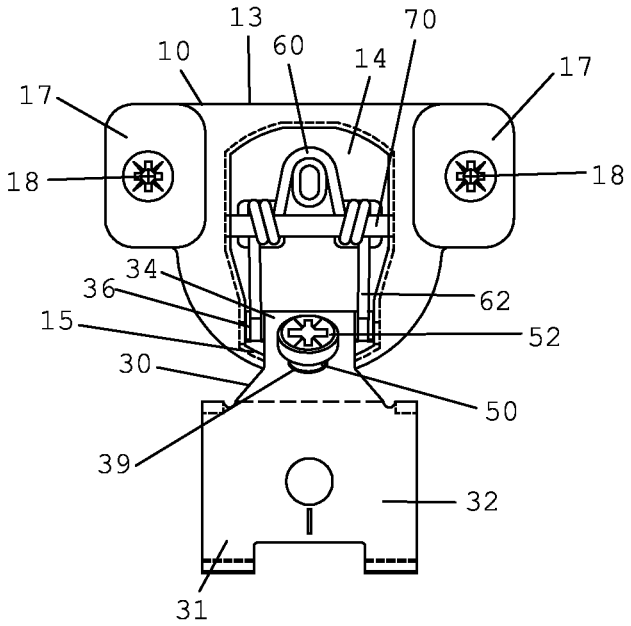
FIG. 6 is a partial plan view of the hinge of FIG. 4.

Referring to FIGS. 3-8, there is illustrated a hinge 10 comprising a recessed cup 13 and an arm 30 extending into the cup 13. The cup 13 is inserted into a bore 19 formed in a cabinet panel 200 or the like. In one form, one end of the cup 13 includes securing flanges 17 extending outwardly from opposing sides of the cup 13. Each flange 17 may include an aperture for receiving fastening screws 18 or the like for securement to cabinet panel 200. At the opposite end of the cup 13 a slanted rim 15 is formed atop an inner wall of a recessed portion 14 of the cup 13. As shown in FIGS. 5 and 6, the rim 15 may be disposed substantially inside the recessed portion 14 of the cup 13. It will be appreciated that the cup 13 can be formed in many ways, such as, for example, from a single pressed piece of sheet metal or casting.

In an embodiment, arm 30 has a first portion 31 and second portion 34. The first portion 31 includes a mounting plate 32 adapted to be secured over a frame 250 or other mounting structure, such as those found in typical sink cabinets or the like. The second portion 34 of the arm 30 extends into the cup 13. In one form, the second portion 34 terminates in a curl 35 that winds around a hinge pin 40 secured in the cup 13, thereby permitting the arm 30 to pivot relative to the cup 13. As the arm 30 pivots form a closed position to an open position, an opening angle A is formed between the outer surface of the cabinet frame 250 and inner surface of the panel 200. In situations where the arm 30 is considered to be stationary—see FIG. 4, for example, where the mounting plate 32 is secured to a cabinet frame 250—it may be understood by some that the cup 13, rather than the arm 30, is adapted to pivot. It will be appreciated that the arm 30, including the first and second portions 31, 34 may be pressed or cast from a single piece of sheet metal having multiple bends.

In an embodiment, arm 30 has a first portion 31 and second portion 34. The first portion 31 includes a mounting plate 32 adapted to be secured over a frame 250 or other mounting structure, such as those found in typical sink cabinets or the like. The second portion 34 of the arm 30 extends into the cup 13. In one form, the second portion 34 terminates in a curl 35 that winds around a hinge pin 40 secured in the cup 13, thereby permitting the arm 30 to pivot relative to the cup 13. As the arm 30 pivots from a closed position to an open position, an opening angle A is formed between the outer surface of the cabinet frame 250 and inner surface of the panel 200. It will be appreciated that the arm 30, including the first and second portions 31, 34 may be pressed or cast from a single piece of sheet metal having multiple bends.

The end of the curl 35 is notched in order to define opposing projections 36. A coil spring 60 winds around a second pin 70 secured in the cup 13 and includes two legs 62 that extend toward and engage projections 36. It will be appreciated that the interaction between the legs 62 of the coil spring 60 and projections 36 effectuate a self-opening and self-closing function. In particular, as the arm 30 pivots from the closed position toward the open position the free ends of the legs 62 pass over corners 37 of the projections 36 generating a moment force which biases the arm 30 towards the open position. Likewise, as the arm 30 pivots from the open position toward the closed position, the free ends of the legs 62 pass over corners 37 of the projections 36 generating a moment force which biases the arm 30 towards the closed position.

Referring to the embodiments shown in FIGS. 3-8, an adjustable stopper 50 extending along a first axis X-X is threaded through a passage 38 formed in an intermediate portion of the arm 30. The stopper 50 may be in the form of a machine screw with a first end 52 in the form of a Phillips drive head or the like, although other structures for stopper 50 may be used as well. The passage 38 penetrates and extends slightly beyond the thickness of the arm 13 in order to permit a sufficient number of threads 39 to be engaged by the stopper 50. Preferably, at least 3 or 4 thread 39 rotations should formed in the passage 38 to ensure the stopper 50 doesn't slip or otherwise disengage during normal operation.

In an embodiment, a second end 55 of the stopper extends toward the cup 13. The termination of the second end 55 may be beveled or chamfered in order to form an angled cross section having a shoulder 58 disposed at an angle relative to the first axis X-X. As the arm 30 pivots to the closed position, the shoulder 58 contacts the rim 15, whereby the rim operates as an abutment surface for the stopper 50. In one form, the cup 13 and stopper 50 are shaped such that the contacting surfaces of the shoulder 58 and rim 15 are disposed substantially parallel to each other to provide increased reliability by decreasing component wear. In that regard, such an arrangement maximizes the area of contact between the shoulder 58 and rim 15, which prevents excess pressure and denting of the rim 15.

Figure 7:
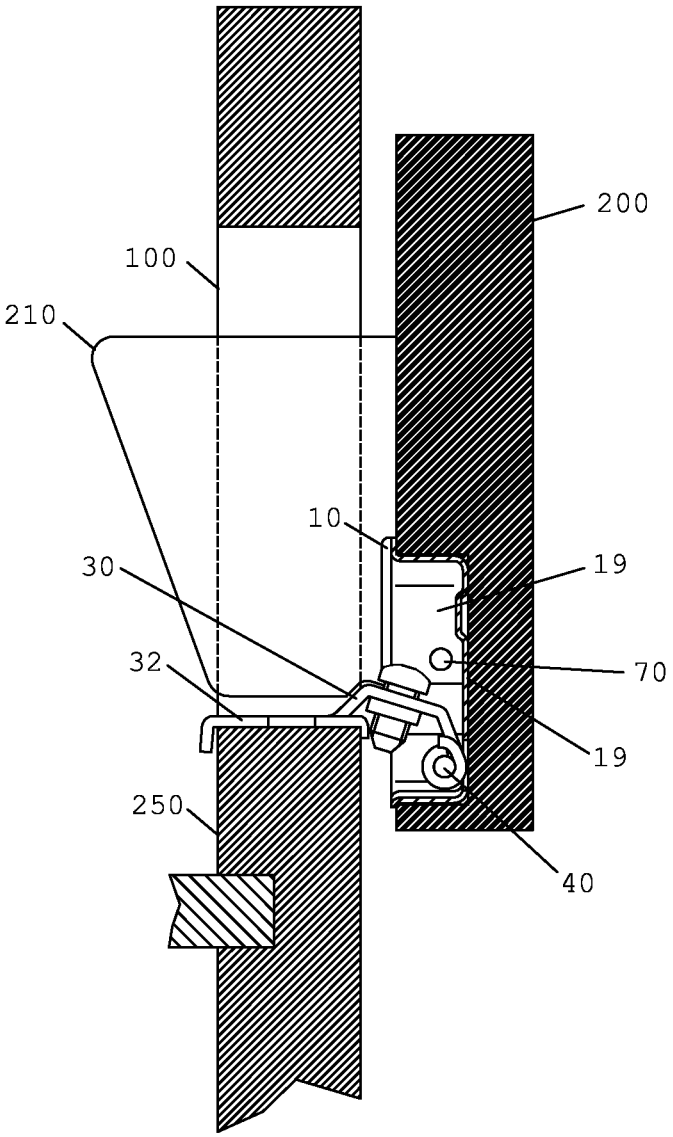
FIG. 7 is a partial cross-sectional view of the hinge of FIG. 3 incorporated with a typical sink tray system having a tray, frame and panel.
Figure 8:
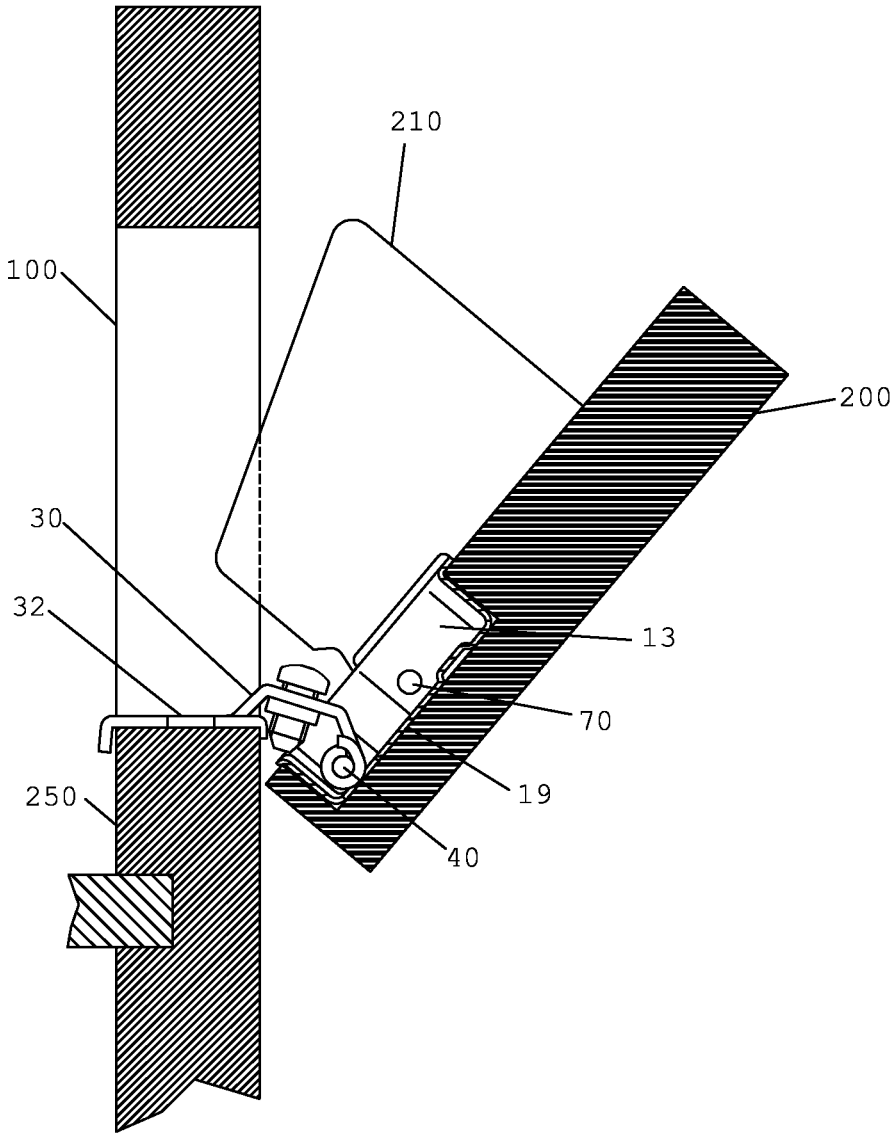
FIG. 8 is a partial cross-sectional view similar to FIG. 7, but showing the hinge in the open position.

As shown in FIGS. 7-8, the hinge 10 may be incorporated in a typical sink tray system 100 where a sink tray or tip-out tray 210 is mounted to the inner surface of the cabinet panel 200 using fastening screws or the like. The fact that the stopper 50 acts to restrict opening angle A permits the tray 210 to pivot inwardly and outwardly of the generally tight space formed between the frame 250 of the sink cabinet, counter top (not shown) and sink tub (not shown).

In a method for installing the hinge 10 in a sink tray system 100, the user begins by inserting the cup 13 into a bore 19 formed in an inner surface of a cabinet panel 200 and securing the flanges 17 to the panel 200 using fastening screws. In a sink tray system 100 incorporating two hinges 5, one hinge 10 is installed on each end of the inner surface of the panel 200, and each of the steps below are repeated for each hinge 10.

The user may then secure the mounting plate 32 to a surface of the frame 250, also using fastener screws or the like. The opening angle A, (i.e. range of opening) can be controlled by manually rotating the stopper 50 using a screw driver or the like, which, depending on the direction of rotation, causes the stopper 50 to thread towards the cup 13 along the first axis X-X, or away from the cup 13, also along the first axis X-X. It will be appreciated that the permitted opening angle A is minimized when the stopper 50 is fully inserted. In an embodiment, the desired opening angle A-A, may be between 20 and 70 degrees, depending on how far the user desires the tray 210 to tip outwardly toward the user. For example, a opening angle A-A too large (generally greater than 90 degrees) may permit the contents of the tray 210 to spill out, while a opening angle A-A too small may fail to permit the user sufficient access to the contents within the tray 210.

Securement of the tray 210 to the inner surface of the panel 200 is achieved by applying fasteners, such as a screw, to mounting slots (not shown) formed on the opposing surface of the tray 210. It will be appreciated that the cup 13 is substantially recessed in the bore 19 and may be arranged to lay substantially flush with an inner surface of the panel 200, thereby permitting additional space for the tray 210 along the inner surface of the panel 200. It will also be appreciated that in a fully assembled sink tray system 100, hinge 10 is substantially concealed behind the panel 200 for aesthetic purposes. Also, in one form, the hinge 10 of the current application permits the tray 210 to be sized in a manner that takes full advantage of the space available in the sink cabinet. In that regard, the tray 210 can be sized to extend substantially the full distance between the side walls 103.

Figure 10:
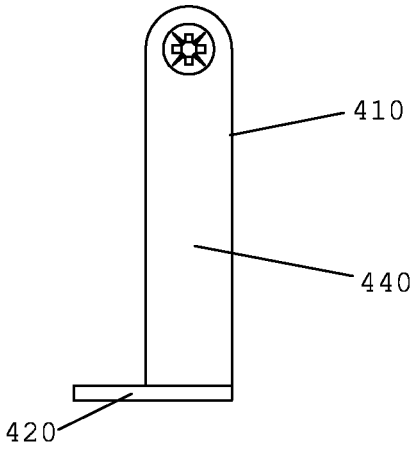
FIG. 10 is an enlarged front view of an embodiment of a safety bracket.
Figure 11:
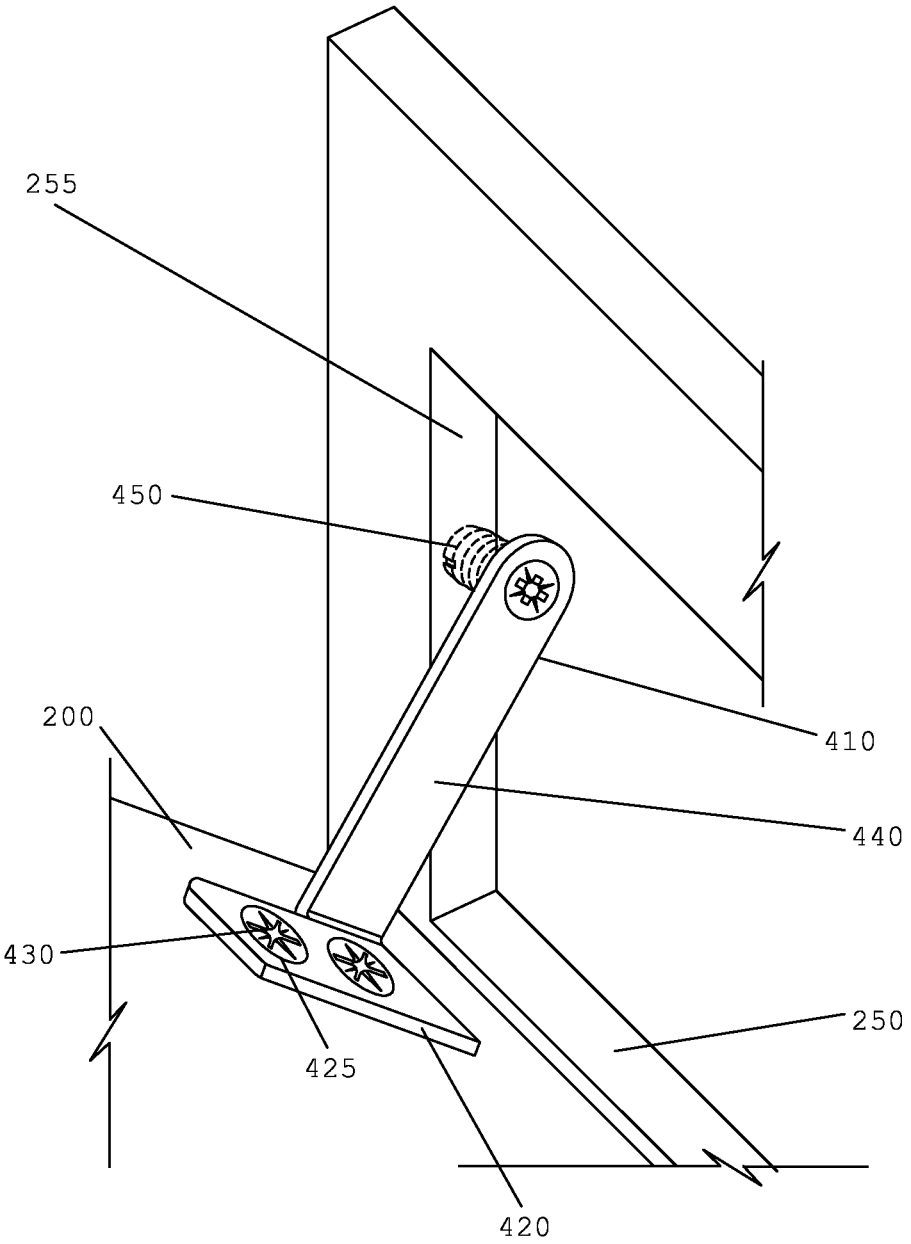
FIG. 11 is a perspective view of the safety bracket of FIG. 10 incorporated with a typical sink tray system.

In one form, the sink tray system 100 may further comprise a safety bracket 410 mounted at either end of the panel 200 to protect against safety hazards associated with excess force being applied to the panel 200 or tray 210. For example, an unattended child who grasps the panel 200 or tray 210 in an attempt to swing or climb may cause forces to be applied to the hinge 10 beyond its weight capacity, which could result in breakage of the hinge 10 at the hinge pin 40 or the like, thereby creating a potential safety hazard. Accordingly, referring to FIGS. 10, 11 safety brackets 410 may be mounted at either end of the panel 200. In one form, the safety bracket 410 comprises an extension 440 with a foot 420 at one end and a catch 450 at the other end. The foot 420 may be provided with two apertures 425 that receive wood screws 430 for fastening the safety bracket 410 to the panel 200. The catch 450 may be in the form of a dowel or the like and can be secured to the extension 440 by means of a machine screw that engages an aperture, as shown in FIG. 11. The safety bracket 410 should be positioned on the panel 200 in a manner that causes the catch 450 to overlap with a vertical member 255 of the cabinet frame 255. In this form, as the hinge 10 and panel 200 pivot toward the open position, the catch 450 is positioned to abut the inner surface of the vertical member 255 of the cabinet frame, thereby preventing the panel 200 from pivoting too wide relative to the vertical member 255.

Figure 9:
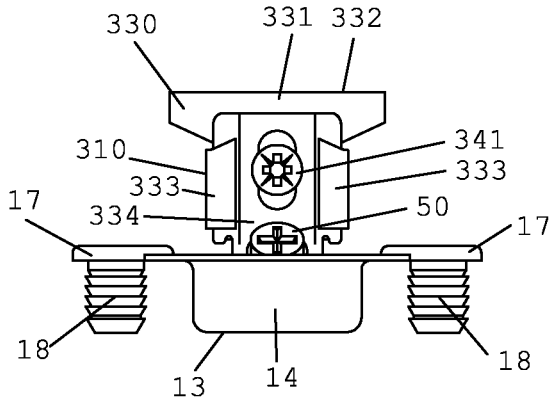
FIG. 9 is an enlarged front view of an embodiment of a multi-adjustable hinge.

In an alternative embodiment shown in FIG. 9, a multi-adjustable hinge 310 may incorporate a two-piece adjustable arm 330 having a mounting plate 332 and jacket 331 having sleeves 333 folded from a single piece of sheet metal. The sleeves 333 are adapted to slideably engage a lower portion 334 that extends into the cup 13. An elongated opening 339 centered in the lower portion 334 is sized to receive an adjustment screw 341 adapted to pass through the elongated opening 339 towards an aperture (not shown) in the rear portion of the jacket 331. In one form, threads formed in this aperture are sized to threadably engage the threads of the adjustment screw 341 in a well known manner. The adjustable stopper 50 is threadably engaged through the passage 38, which is substantially centered in the lower portion 334 of the arm below the elongated opening 339. It will be appreciated that the cup 13, spring loaded self-opening and self-closing and angle adjustment features of the alternative embodiment shown in FIG. 9 operate with a design and structure substantially the same to those shown in the embodiment of FIGS. 3-8.

In operation of the alternative embodiment shown in FIG. 9, loosing of the adjustment screw 341 enables the jacket 331 and mounting plate 332 to shift vertically relative to lower portion 334, thereby permitting vertical adjustment of the surfaces relative to each other to which the mounting plate 332 and cup 13 are attached. For example, the additional adjustment feature of the multi-adjustable hinge 310 may permit vertical adjustment of the cabinet frame 250 relative to the panel 200, should the multi-adjustable hinge 310 be used with the a typical sink tray system 100, such as those shown in FIGS. 7-8. The adjustment screw 334 can be turned for tightening purposes in order to prevent movement of the mounting plate 332 relative to the lower portion 334 when they have reached their desired relative positions.

It will be appreciated that while the components of the adjustable and multi-adjustable hinges 10, 310 are made of cold rolled steel in one form, other sufficiently rigid materials may also be used, such as plastics or metals.

The matter set forth in the foregoing description and accompanying drawings is offered by way of illustration only and not as a limitation. While particular embodiments have been shown and described, it will be appreciated that changes and modifications may be made without departing from the broader aspects of applicants' contribution.

What is claimed is:

1. A sink tray system comprising:

a hinge having a cup with a recessed portion and a rim disposed substantially inside the recessed portion, the cup being secured to a panel with a sink tray mounted thereon;

an arm having a passage and a mounting plate secured to a frame of a cabinet, the arm being pivotably coupled to the cup, wherein the cup is adapted to pivot between closed and opened positions, the opened position defining an opening angle between the cup and the arm; and a stopper threadably coupled with the passage, and adapted to abut the rim, whereby the opening angle is adjustable by rotation of the stopper relative to the arm.

2. The sink tray system of claim 1 wherein an inner recessed wall of the cup and rim are formed from a single piece of sheet metal, and the arm and mounting plate are formed from a single piece of metal.

3. The sink tray system of claim 2 wherein the tray is sized to extend substantially between opposing side walls of the cabinet.

4. The sink tray system of claim 3 further comprising a safety bracket having a first end with a foot mounted to the panel and a second end with a catch adapted to abut a vertical member of the cabinet when the hinge is in the open position.

5. The sink tray system of claim 1 wherein the cup is fitted into a bore formed in the inner surface of the panel whereby the hinge is substantially concealed.

* * * * *